US005947322A

United States Patent [19]

Ho

[11] Patent Number: 5,947,322

[45] Date of Patent: Sep. 7, 1999

[54] MULTIPLE-PURPOSE CONTAINER DETACHABLY MOUNTED ON WALL

[76] Inventor: Chin-Huan Ho, No. 73-3, Cheng-Kung S. Rd., Chung-Ho Taipei Hsien, Taiwan

[21] Appl. No.: 09/083,365

[22] Filed: May 21, 1998

[51] Int. Cl.[6] ..... B65D 3/00

[52] U.S. Cl. ..... 220/477; 220/481; 220/576; 220/697; 220/700

[58] Field of Search ..... 220/700, 695, 220/735, 730, 481, 477, 697

[56] References Cited

U.S. PATENT DOCUMENTS

| | | | |
|---|---|---|---|
| 323,420 | 8/1885 | Hills | 220/695 |
| 348,160 | 8/1886 | Goldsmith | 220/730 |
| 752,591 | 2/1904 | Robinson | 220/699 |
| 1,767,476 | 6/1930 | Putterman | 220/576 |
| 2,608,843 | 9/1952 | Kennedy | 220/481 |
| 2,864,510 | 12/1958 | Stung | 220/735 |
| 3,326,409 | 6/1967 | Speer | 220/700 |
| 3,526,314 | 9/1970 | Trammell, Jr. | 220/481 |
| 4,088,250 | 5/1978 | Schaefer | 220/481 |
| 4,821,906 | 4/1989 | Clark | 220/481 |
| 5,058,764 | 10/1991 | Gaba | 220/481 |
| 5,213,294 | 5/1993 | DeBord | 220/481 |

*Primary Examiner*—Joseph M. Moy

[57] ABSTRACT

A multiple-purpose container including: a cup-like container having at least a groove longitudinally formed in a side wall of the container; a convertible tray detachably securable on an upper portion of the container having a central opening and a plurality of holes formed in the tray; and a hanger member fixed on a wall of a building, a table, a car and a fixture and having an extension formed on the hanger member to be slidably engageable with the groove recessed in the container, whereby upon coupling of the container on the hanger member, the container will serve as an ash tray, a pen holder, a cup, a flower vase or a garbage container; and upon uncoupling of the container from the hanger member, the container will be free moved or handled.

6 Claims, 6 Drawing Sheets

MULTIPLE-PURPOSE CONTAINER DETACHABLY MOUNTED ON WALL

BACKGROUND OF THE INVENTION

U.S. Pat. No. 2,963,256 to J. E. Borah disclosed an article retainer to provide a holding and gripping device for articles such as drinking glasses, mixing bowls, flower pots, and the like, having a suction cup (30) made of rubber or rubber-like material formed on a bottom of a gripping device (10) to be sucked by vacuum on a supporting surface (31). If the supporting surface (31) is not a flat smooth surface, the vacuum suction cup (30) will not be well sucked on the surface, still causing unstable holding of the article thereon.

The present inventor has found the drawbacks of the conventional article retainer and invented the present container detachably mounted on a wall.

SUMMARY OF THE INVENTION

The object of the present invention is to provide a multiple-purpose container including: a cup-like container having at least a groove longitudinally formed in a side wall of the container; a convertible tray detachably securable on an upper portion of the container having a central opening and a plurality of holes formed in the tray; and a hanger member fixed on a wall of a building, a table, a car and a fixture and having an extension formed on the hanger member to be slidably engageable with the groove recessed in the container, whereby upon coupling of the container on the hanger member, the container will serve as an ash tray, a pen holder, a cup, a flower vase or a garbage container; and upon uncoupling of the container from the hanger member, the container will be free moved or handled.

DETAILED DESCRIPTION

Figure 1:
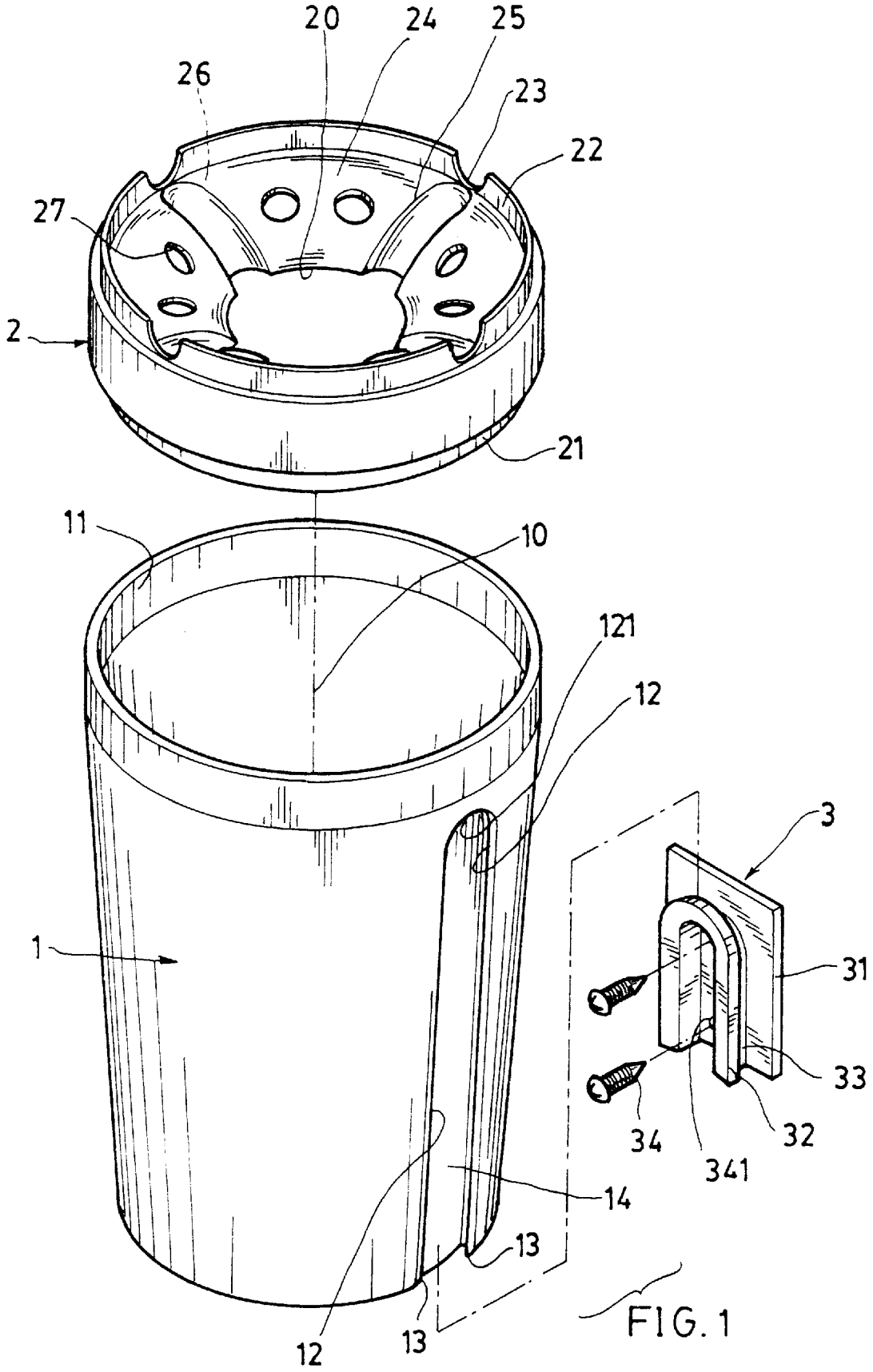
FIG. 1 is an exploded view of the present invention.

As shown in FIGS. 1–6, the multiple-purpose container of the present invention comprises: a cup-like container 1, a convertible tray 2 detachably secured on the container 1, and a hanger member 3 fixed on a wall W of a building, a house, a fixture or a car for detachably mounting the container 1 on the hanger member 3. The present invention may be made of plastic materials or other suitable materials. Even though the container 1 and tray 2 are formed as cylindrical shape as illustrated, their shapes are not limited in the present invention.

The cup-like container 1 is formed with a closed bottom and an open top having an upper rim 11 confining the open top of the container 1, having a longitudinal axis 10 defining at a longitudinal center of the container 1.

Figure 2:
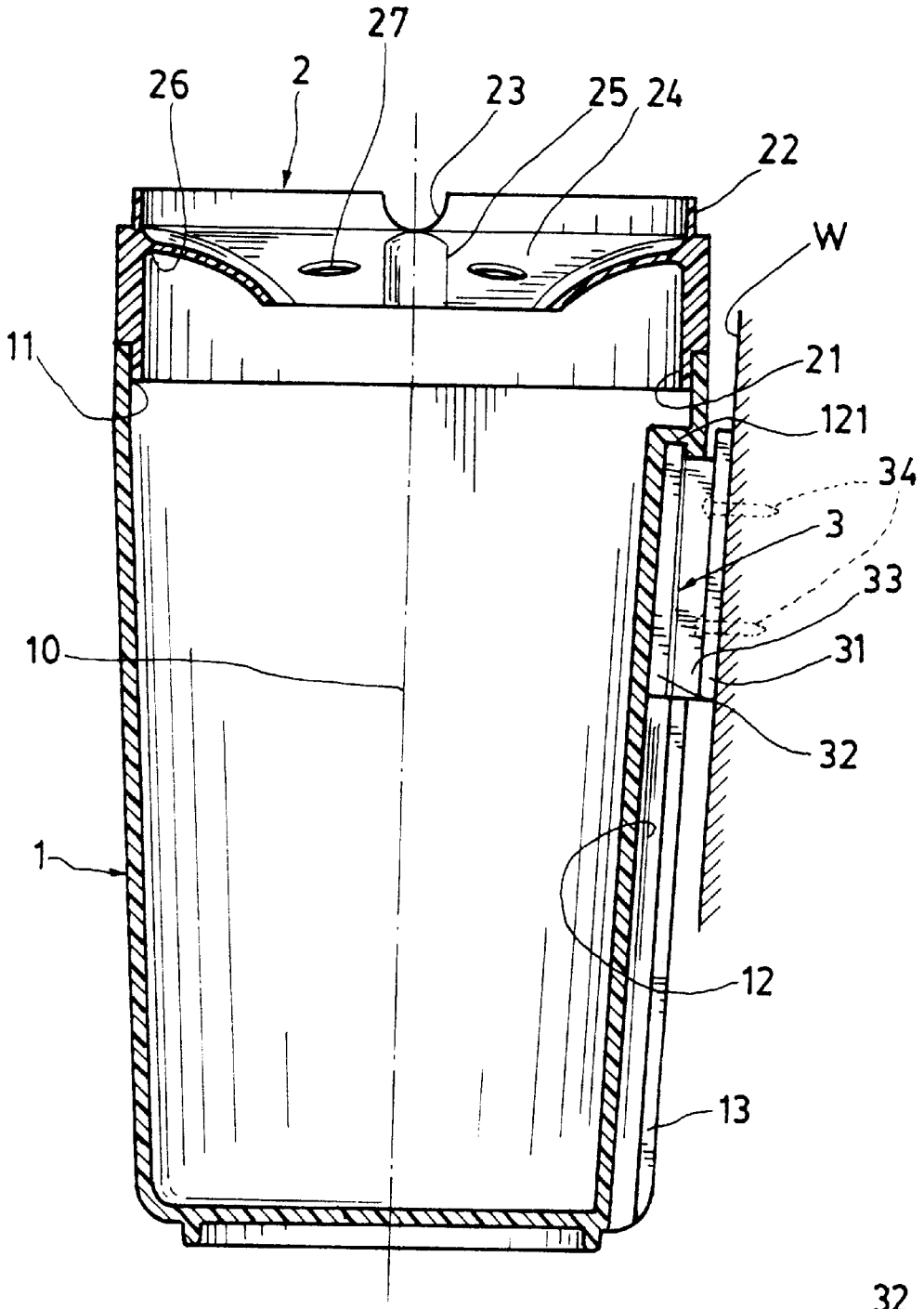
FIG. 2 is a longitudinal sectional drawing of the present invention when assembled.
Figure 2A:
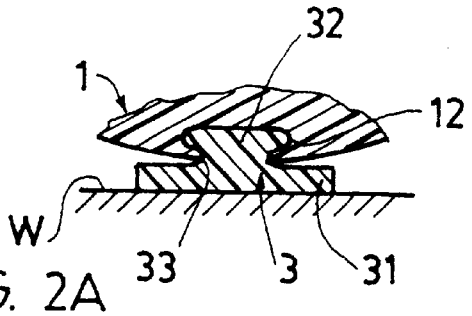
FIG. 2A is a partial cross sectional drawing of the container coupled with hanger member.

The cup-like container 1 is formed with at least a groove 12 longitudinally formed in a side wall of the container 1, and transversely enlarged from a slot 14 longitudinally formed in the side wall of the container to define an omega shape as shown in FIG. 2A, having a flap portion 13 formed on the side wall of the container 1 and juxtapositioned to the slot 14 to be convex outwardly from the groove 12 to limit the hanger member 3 when engaged in the groove 12, and a stopping end portion 121 formed at an upper end portion of the groove 12 and the slot 14 to be rested upon the hanger member 3 when the container 1 is engageably mounted on the hanger member 3 which is fixed on a wall W (FIG. 2).

Figure 3:
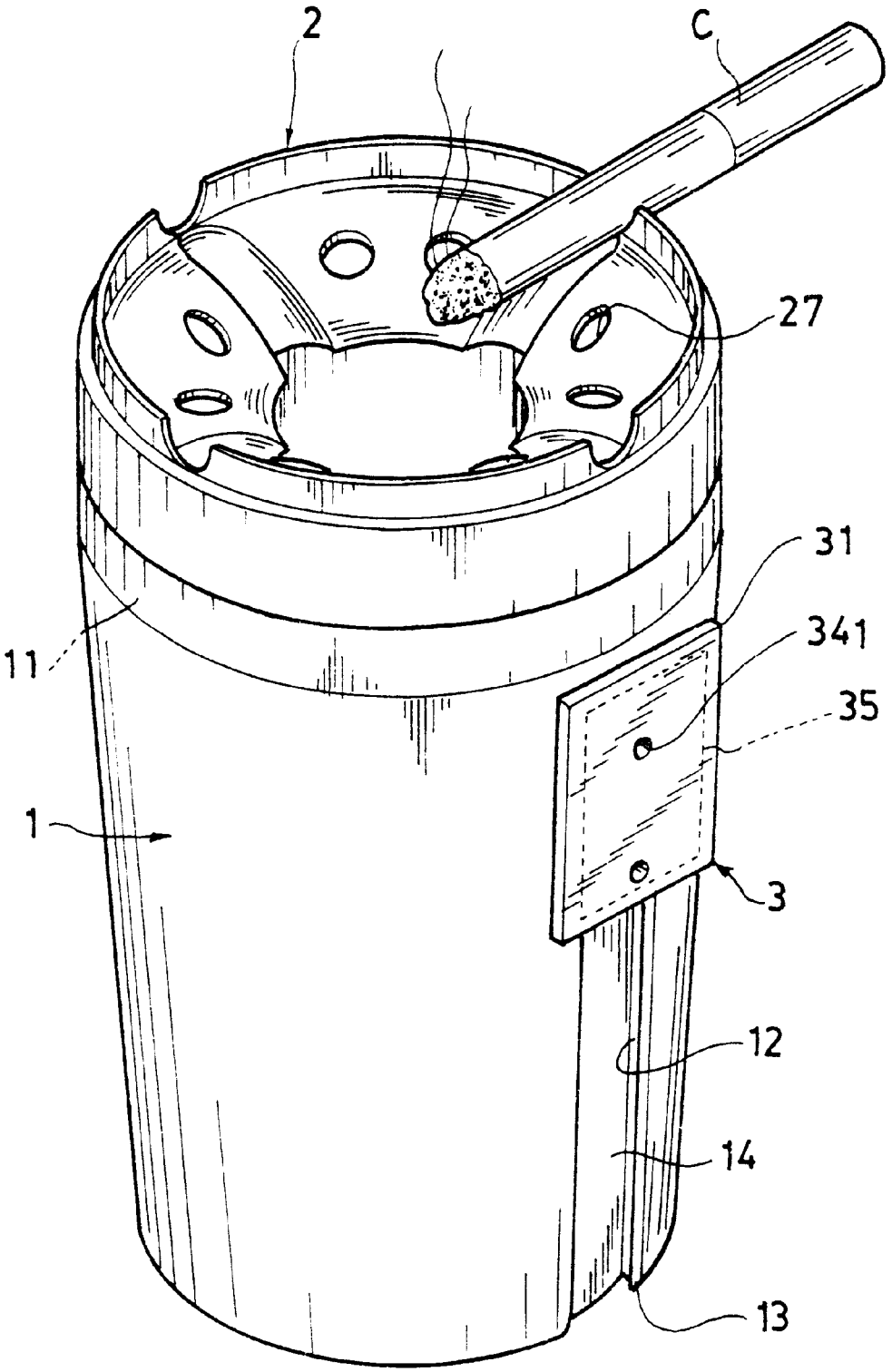
FIG. 3 is a perspective view of the present invention when served as an ashtray.

The convertible tray 2 includes: a first periphery portion 21 and a second periphery portion 22 disposed on opposite ends of the tray 2, a diaphragm 24 formed in a central portion within the tray 2 having a central opening 20 formed through the diaphragm 24, a plurality of notches 23 recessed in the second periphery portion 22 and a plurality of shallow grooves 25 each radially recessed in the diaphragm 24 and projectively aligned with each notch 23, with the diaphragm 24 inclined downwardly radially towards the central opening 20, whereby upon engagement of the first periphery portion 21 on the upper rim 11 of the cup-like container 1, a cigarette C may be embedded in the notch 23 and the shallow groove 25 of the tray 2 which is thus served as an ash tray for cigarette smoker (FIG. 3).

Figure 4:
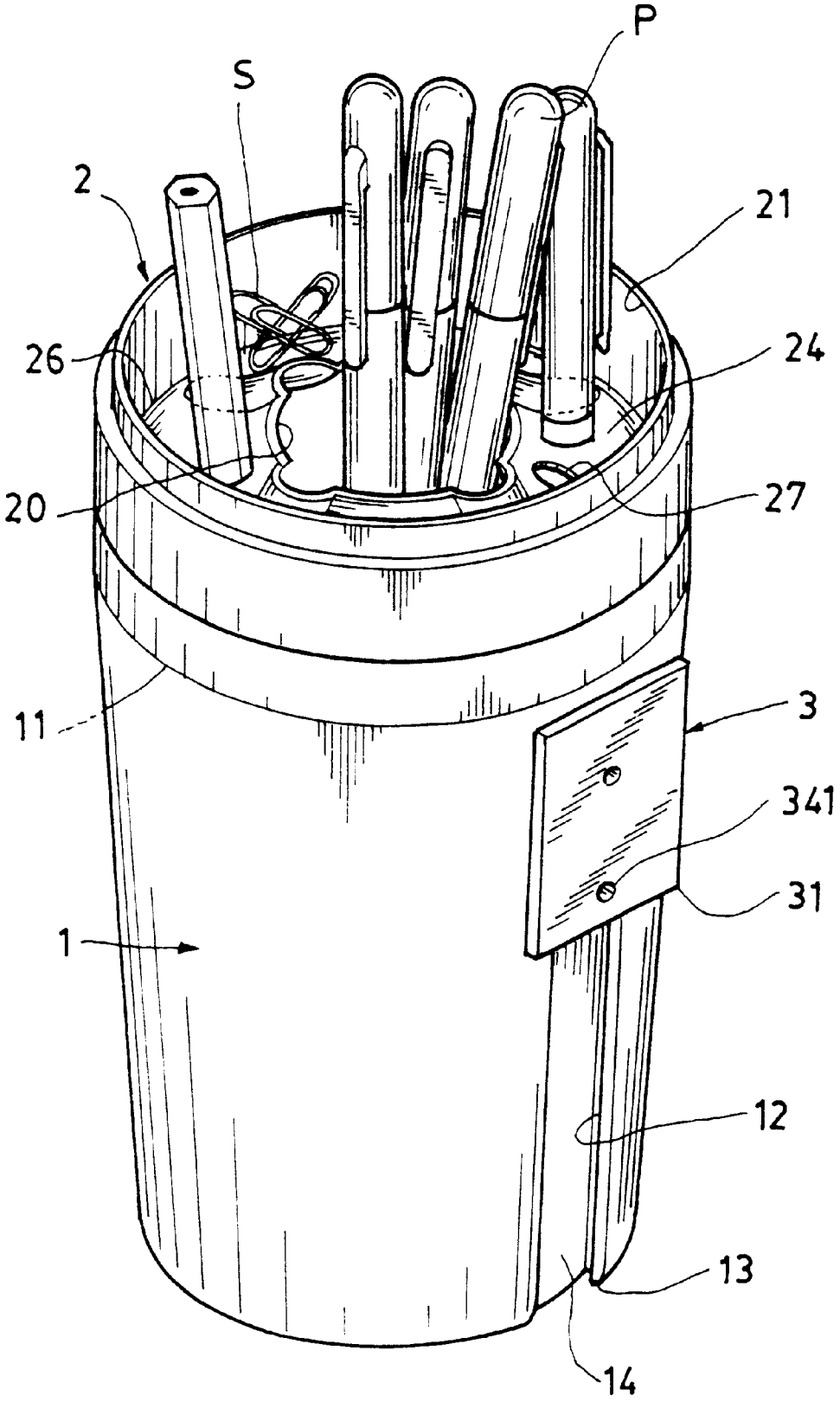
FIG. 4 is an illustration of the present invention when served as a pen or stationery holder.
Figure 6:
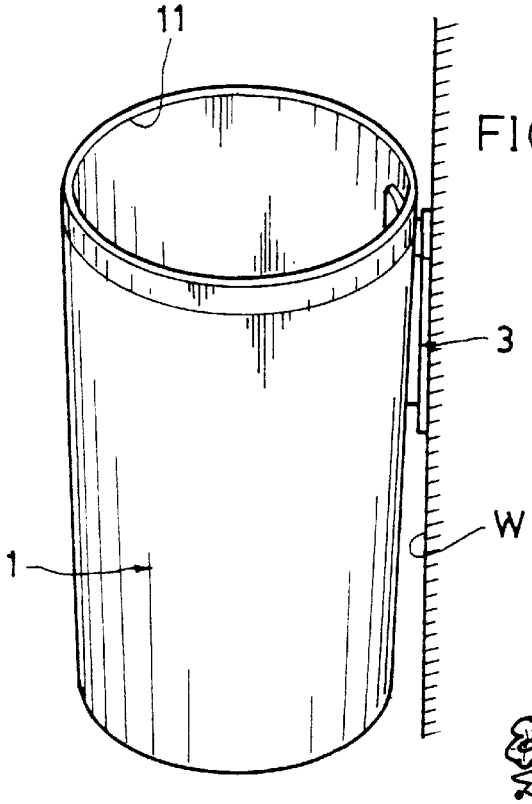
FIG. 6 is an illustration of the present invention served as a cup.

The tray 2 further includes: a plurality of holes 27 formed in the diaphragm 24, whereby when inverting the tray 2 from FIG. 3 to FIG. 4 to engage the second periphery portion 22 with the upper rim 11 of the container 1 to conceal the notches 23 within the rim 11 of the container, the tray 2 will serve as a pen holder or stationery holder to insert pen or ball pen P in the holes 27 and to store clips S or other small stationery items in a corner 26 defined between the diaphragm 24 and a side wall of the tray 2.

Figure 5:
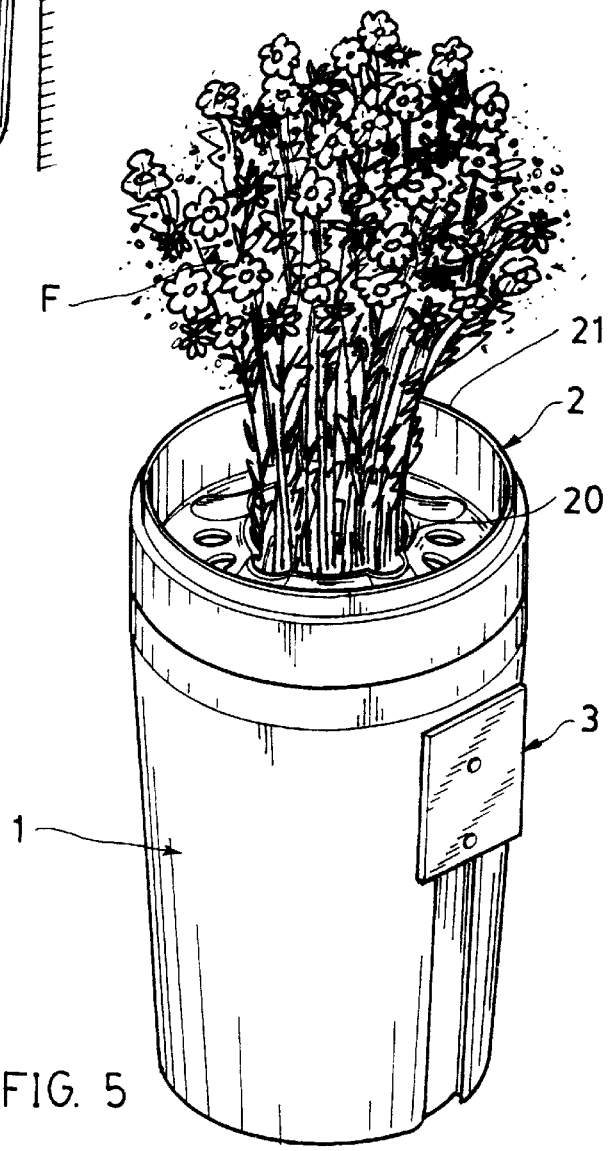
FIG. 5 is an illustration of the present invention when served as a flower vase.

The flower F may be held in the central opening 20 of the tray 2 as shown in FIG. 5 to allow this invention to be a flower vase or pot (FIG. 5). Naturally, the tray 2 may be removed from the container 1 to allow the container 1 to serve as a drinking cup or a garbage container especially when used in a car.

The hanger member 3 includes: a base 31, at least an extension 32 secured on the base 31 through a neck portion 33 contiguous to the base 31, with the extension 32 enlarged from the neck portion 33 to be slidably engageable with the groove 12 in the container 1, and with the neck portion 33 slidably engageable with the slot 14 in the container 1. The base 31 is secured on a wall W by an adhesive tape or Velcro tape 35, or by screws 34 which are fixed on the wall W through screw holes 341 formed in the base 31.

The extension 32 connected with the neck portion 33 may be formed as a dovetail shape or an inverse-U shape to be engageable with the groove 12 in the container 1, and the extension 32 of the hanger member 3 will be limited by the flap portion 13 juxtapositioned to the slot 14 and convex outwardly from the groove 12 of the container 1 to stably mount the container 1 on the hanger member 3 which is pre-fixed on a wall W.

Figure 8:
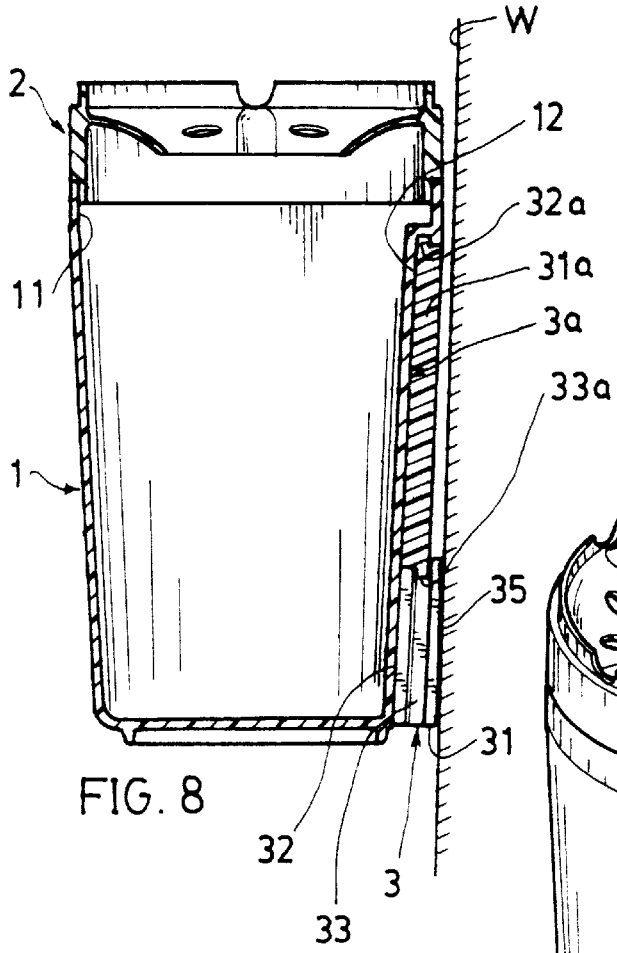
FIG. 8 is a sectional drawing of the embodiment as shown in FIG. 7.
Figure 7:
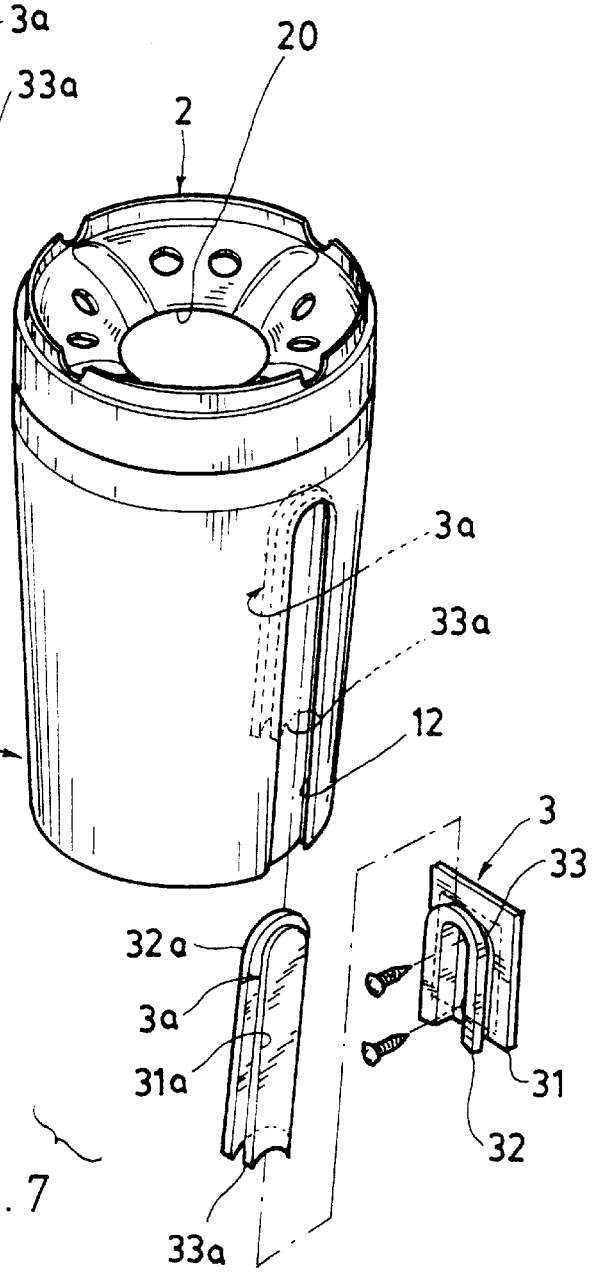
FIG. 7 is an exploded view of another preferred embodiment of the present invention.

If the groove 12 is to be shortened to allow a quick coupling or uncoupling of the container 1 on or from the hanger member 3 in accordance with the present invention, an insert member 3*a* may be inserted into the groove 12 as shown in FIGS. 7, 8.

The insert member 3*a* may be made as an elongate strip 31*a* having an elongate extension 32*a* integrally formed on the strip 31*a* to be slidably engageable with the groove 12 recessed in the container 1, with the strip having a length shorter than a length of the groove, whereby upon embedding of the insert member 3*a* in the groove 12 of the container to be limited by a stopping end portion 121 formed on an upper end of the groove 12, the groove in the container will be shortened and a bottom 33*a* of the insert member 3*a* will be rested upon the extension 32 of the hanger member 3 to stably mount the container 1 on the hanger member 3 which is pre-fixed on the wall W such as by adhesive tape 35 as shown in FIG. 8 or by other joining methods.

The present invention is superior to a conventional article retainer because the container may be easily detachable from the hanger member, which is stably fixed on a wall, not sucked on a flat surface. Also, this invention may serve for multiple convertible uses as aforementioned.

The present invention may be modified without departing from the spirit and scope of this invention.

I claim:

1. A multiple-purpose container comprising:

a cup-like container having a closed bottom and an open top, and having at least a groove recessed in a slot longitudinally formed in a side wall of the container;

a convertible tray having a first periphery portion and a second periphery portion disposed on opposite ends of the tray, and having a diaphragm transversely formed in a central portion within the tray as defined between the first and the second periphery portions and having a central opening and a plurality of holes formed in the diaphragm for holding flowers and pens in said container through said central opening and said holes formed in said tray; said first periphery portion of said tray engageable with an upper rim of said container and said second periphery portion having a plurality of notches recessed in the second periphery portion for embedding a cigarette in each said notch to serve as an ash tray; and a hanger member fixed on a wall and having at least an extension slidably engageable with said groove in said container for detachably mounting said container on said hanger member; whereby upon inversion of said convertible tray by engaging the second periphery portion of said tray on said upper rim of said container to conceal the notches on the tray within the upper rim of the container, and positioning said first periphery portion on an upper end of the tray and the container, said tray and said container will be provided for holding at least a flower or a pen in said container and in said tray to serve as a flower vase or a pen holder; and upon removal of the tray, the container will be served as a drinking cup or an article container.

2. A multiple-purpose container according to claim 1, wherein said groove in said container is transversely enlarged from said slot formed in said container, and said slot having a flap portion juxtapositioned to said slot, with said flap portion being convex outwardly from said groove for limiting said extension of said hanger member when engaged in said groove in said container; and said container having a stopping end portion formed on an upper end of said groove for resting said container on said extension of said hanger member when coupled with said container.

3. A multiple-purpose container according to claim 2, wherein said hanger member includes said extension connected to a base, which is pre-fixed on a wall, through a neck portion slidably engageable with said slot in said container; said extension formed as a dovetail shape, a T shape or pi($\pi$)shape to be engageable with said groove in said container formed as an omega shape, a C shape or an inverse-U shape.

4. A multiple-purpose container according to claim 1, wherein said convertible tray has said diaphragm inclined radially downwardly towards a longitudinal axis defined at a center of said container, having a plurality of shallow grooves radially recessed on the diaphragm and each said shallow groove projectively aligned with each said notch formed on a periphery portion of said tray for embedding a cigarette on said notch and said shallow groove.

5. A multiple-purpose container according to claim 1, wherein said container and said tray are generally formed as cylindrical shape.

6. A multiple-purpose container according to claim 1, wherein said container further includes an insert member which is made as an elongate strip having an elongate extension integrally formed on the strip to be slidably engageable with the groove recessed in the container, with the strip having a length shorter than a length of the groove, whereby upon embedding of the insert member in the groove of the container to be limited by a stopping end portion formed on an upper end of the groove, the groove in the container will be shortened and the insert member will be rested upon the extension of the hanger member to stably mount the container on the hanger member which is pre-fixed on the wall.

* * * * *